US006290765B1

(12) United States Patent
Jaycock et al.

(10) Patent No.: US 6,290,765 B1
(45) Date of Patent: Sep. 18, 2001

(54) ROSIN EMULSION INCLUDING STARCH DERIVATIVE FOR PAPER SIZING

(75) Inventors: Michael James Jaycock, Loughborough; Martin Derek Phillipson, Lower Darwen, both of (GB); Claes Zetter; Tapio Vihervaara, both of Turku (FI)

(73) Assignee: Raisio Chemicals Limited UK, Lancashire (GB)

( * ) Notice: Subject to any disclaimer, the term of this patent is extended or adjusted under 35 U.S.C. 154(b) by 0 days.

(21) Appl. No.: 09/319,100

(22) PCT Filed: Dec. 1, 1997

(86) PCT No.: PCT/GB97/03197

§ 371 Date: Nov. 8, 1999

§ 102(e) Date: Nov. 8, 1999

(87) PCT Pub. No.: WO98/24972

PCT Pub. Date: Jun. 11, 1998

(30) Foreign Application Priority Data

Nov. 30, 1996 (GB) ..... 9625006

(51) Int. Cl.[7] ..... C09D 103/02; C09D 103/20

(52) U.S. Cl. ..... 106/215.3; 106/208.5; 106/145.2

(58) Field of Search ..... 106/205.4, 208.5, 106/215.3, 145.2

(56) References Cited

U.S. PATENT DOCUMENTS 4,333,795 * 6/1982 Street ..... 162/175

OTHER PUBLICATIONS

CAPLUS 1993:430260, Vihervaara et al, "Raifix–new cationic polymers for controlling . . .".*

* cited by examiner

*Primary Examiner*—David Brunsman
(74) *Attorney, Agent, or Firm*—Woodward, Emhardt, Naughton

(57) ABSTRACT

A "one-shot" composition for use in paper sizing comprises an admixture of a rosin emulsion, a soluble aluminium salt and a cationic starch derivative which has a charged state of 1.0 to 3.5 m equivalents per gramme and which is produced by a process in which the starch structure was split prior to the cationising step.

34 Claims, 1 Drawing Sheet

Figure 1. % Nitrogen as a function of degree of substitution for starch cationized using 2,3-epoxypropyl-trimethylammonium chloride.
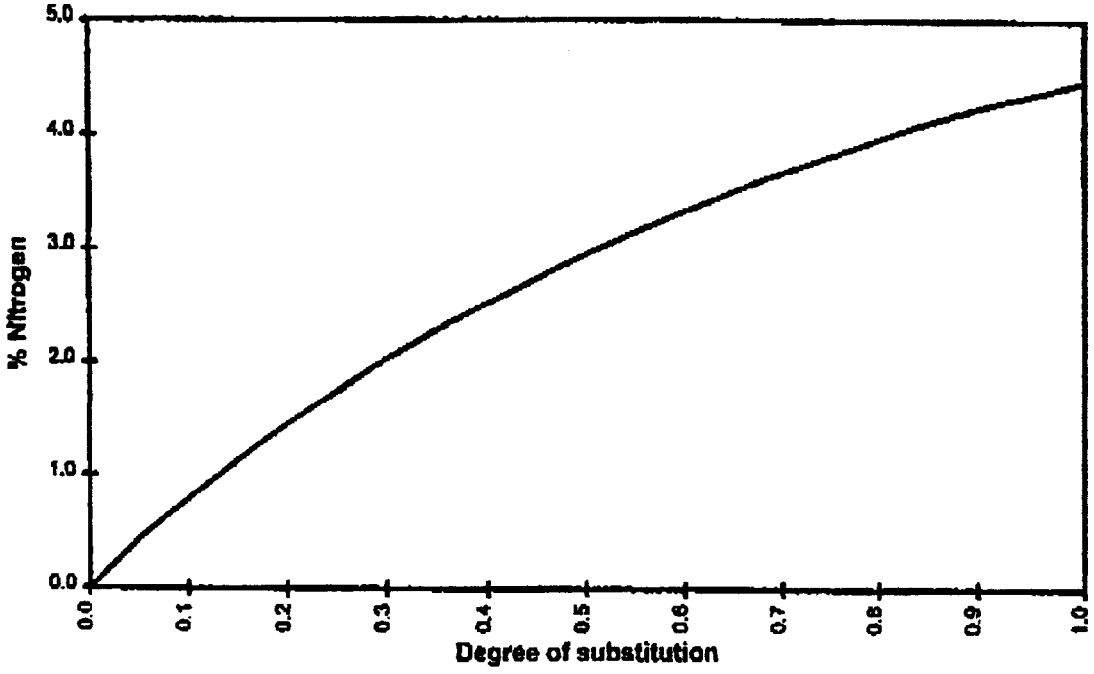

ROSIN EMULSION INCLUDING STARCH DERIVATIVE FOR PAPER SIZING

This application is a 371 of PCT/GB97/03197 filed on Dec. 1, 1997.

The present invention relates to a "one-shot" rosin emulsion incorporating a cationic starch derivative for use in paper sizing and also relates to a method of paper sizing using the one-shot composition.

It is well established practice to effect paper sizing by use of a rosin emulsion and a soluble aluminium salt such as aluminium sulphate (e.g. in the form of papermakers alum [$Al_2(SO_4)_3$. 16–18$H_2O$], aluminium chloride, polyaluminium chloride or aluminium chlorohydrate. (Although the term "emulsion" is conventionally used to describe the rosin product it should more properly be called a dispersion since although made as an emulsion, the particles are effectively solid at ambient temperature). The rosin emulsion and aluminium salt are generally used as separate additions to the paper making process. It is however also known to formulate so-called "one-shot" compositions which are formed by pre-mixing a rosin emulsion and an aluminium salt. The use of a "one-shot" composition avoids the need for separate additions of rosin emulsion and aluminium salt to the paper making process.

"One-shot" composition may be produced by vigorous stirring of an anionic Bewoid rosin emulsion (e.g. stabilised with casein) and an aluminium salt such that agitation is continued beyond formation of an initial precipitate to convert the latter into a cationic emulsion. Production of such emulsions using this technique is disclosed in GB-A-2 050 453.

Cationic emulsions made by this type of technique are not in very common use although there are a few which are still on the market. A limitation of such cationic emulsions is that often they are not as stable as the anionic rosin emulsions from which they are derived, and obtaining reproducibility is not always easy. It has therefore been the practice to include a cationic stabiliser as one component of the emulsion formed from the anionic Bewoid emulsion and the aluminium salt. Examples of such cationic stabilisers include quaternised and other cationised starches.

There is however a problem with existing "one-shot" compositions incorporating a conventional cationic starch as a stabiliser in that only relatively low amounts of the starch may be used without the "one-shot" composition becoming excessively viscous for economic use in a paper making process. This is a problem because conventionally used cationic starches are of relatively low "cationicity" and therefore the amount of the starch which may be tolerated in the "one-shot" composition may be insufficient to bring about the charge reversal of the initial anionic emulsion to give a cationic emulsion.

It is therefore an object of the present invention to obviate or mitigate the abovementioned disadvantages.

According to the present invention there is provided a "one-shot" composition for use in paper sizing comprising an admixture of a rosin emulsion, a soluble aluminium salt and a cationic starch derivative which has a charged state of 0.5 to 5.0 m equivalents per gramme and which has been produced by a process in which the starch structure was split prior to the cationising step.

The composition of the invention thus incorporates a cationic polymer derived from a degraded starch and having a charge density (i.e. the average number of milliequivalents of cationised atoms per gramme of polymer) of 0.5 to 50. This is somewhat higher than conventional cationic starches which are generally considered to have a charge density in the range 0.1 to 0.3 m equivalents per gramme. Furthermore, the fact that the cationic polymer is produced from a degraded starch means that it (i.e. the cationic polymer) is of lower molecular weight than conventional cationic starches with a consequential reduction in viscosity. The low viscosity and higher charge of the cationic polymer permits the charge of an anionic rosin emulsion to be reversed at low concentrations of the cationic polymer to produce a useable cationic emulsion and to produce a range of cationicities that may be tailored to meet specific demands of a mill.

Preferably the cationic polymer has a charge density of 0.5 to 4.5 and more preferably 1 to 3.5 m equivalents per gramme.

Cationic polymers produced from degraded starch for use in the invention may be produced with a range of molar masses and degree of cationisation. Furthermore, it is possible for solutions of such polymers to be produced containing up to 55% by weight of the polymer without being excessively viscous. Therefore it is possible in accordance with the invention to produce a range of "one-shot" cationic compositions which have sufficient cationicity for a particular application without being too viscous.

It is preferred that the cationic polymer employed in the invention is a quaternised derivative of a degraded starch. Preferably such a derivative has a degree of substitution of at least 0.15, more preferably 0.15 to 1.30 and even more preferably 0.20 to 1.10 quaternary groups per glucose unit. Ideally this degree of substitution is 0.20 to 0.80 and most preferably 0.50 to 0.80.

The cationic polymers used in the present invention may be produced by treating starch with an agent which will partially "fragment" the polysaccharide chain (e.g. by use of an oxidising agent such as hydrogen peroxide) and subsequently cationising the "fragmented" product in a reaction in which the solids content is a minimum of 50% (more preferably at least 55%) by weight. The cationizing agent may be used in an amount of 20 to 160%, most preferably 80 to 120%, by weight of the amount of degraded starch thereby allowing the degree of cationization to be readily controlled.

The preferred quaternising chemical is 2,3-epoxypropyl trimethyl ammonium chloride although other cationizing agents may be used.

Preferred cationic polymers for use in the invention have a nitrogen content in the range of approximately 1–5% (for the cationizing chemical being 2,3-epoxypropyl trimethyl ammonium chloride). It is particularly preferred that cationic, oxidised starch derivatives for use in the invention have a nitrogen content of 3–5%, more preferably 3–4%, and ideally about 3.5% (for the cationizing chemical being 2,3-epoxypropyl trimethyl ammonium chloride).

BRIEF DESCRIPTION OF THE DRAWING

The relationship between the nitrogen content of the cationic polymer (quaternised using 2,3-epoxypropyl trimethyl ammonium chloride) and degree of substitution per glucose unit is illustrated in FIG. 1 of the accompanying drawings. It can be seen from the graph of FIG. 1 that the polymer mentioned above containing 3–4% of nitrogen have a degree of substitution in the range of about 0.53 to about 0.8.

It is preferred that the cationic polymer for use in the invention has a molecular weight in the range of 100,000 to 500,000 Daltons, more preferably 150,000 to 450,000.

Further details as to the manner in which the cationic polymers may be manufactured are given in WO-A-95/

18157 and Finnish Patents Nos. 94135 and 94128 (all in the name of Raisio Chemicals). The disclosures of these prior specifications are hereby incorporated by reference.

Particularly suitable quaternised, oxidised starch derivatives for use in formulating the emulsions of the invention are available under the trade mark RAIFIX which designates a range of products of varying cationicity and molecular weight. Typical RAIFIX products have a degree of substitution (by the cationizing agent) of 0.1 to 1.1 which corresponds to a nitrogen content in the range of approximately 1–5% (for the cationizing chemical being 2,3-epoxypropyl trimethyl ammonium chloride).

RAIFIX products are available under the following five figure product codes:

| | | | |
|---|---|---|---|
| Raifix 01035 | Raifix 07035 | Raifix 15035 | Raifix 25035 |
| Raifix 01025 | Raifix 07025 | Raifix 15025 | Raifix 25025 |
| Raifix 01015 | Raifix 07015 | Raifix 15015 | Raifix 25015 |

In these product codes, the first three figures are representative of molecular weight (the higher the number of higher the percentage molecular weight) and the final two figures being approximately ten times the nitrogen content. Estimates of the relative molar mass of the RAIFIX products are 100,000 Daltons for the 010xx designations and 500,000 Daltons for the 250xx designations.

The range of degree of substitution and relative molar mass available in the RAIFIX series of products permits "one-shot" compositions to be formulated tailored to suit the cationic requirements of a particular furnish with which it is to be used and (to a certain extent) the retention and drainage conditions of the paper making machine on which the composition will be used.

The rosin used in the emulsion of the invention may be for example be a wood rosin, gum rosin, tall oil resin or mixtures thereof. The resin may be maleated, fortified, unfortified, hydrogenated or disproportionated. The rosin may optionally be esterified. If a tall oil rosin is used then it is preferred that it be pre-treated with paraformaldehyde.

The preferred rosin for use in the invention is a maleated or fumarated rosin.

If desired, the rosin may be compounded with tall oil fatty acids as proposed in UK-A-2 268 941. Tall oil fatty acids are available for example under the designation CENTURY MO6 (ex Union Camp Chemicals Limited). Any other rosin diluent (e.g. a hydrocarbon resin) may alternatively be used.

The rosin emulsion from which the "one-shot" composition is produced may, for example, have a solids content of 30 to 50% by weight. This emulsion may be of a rosin which has been fortified with maleic anhydride or fumaric acid. The emulsion may be an anionic rosin emulsion, e.g. a casein stabilised Bewoid rosin emulsion. It is however also within the scope of the invention that the rosin emulsion (from which the one-shot composition is produced) be a cationic rosin emulsion (e.g. as described in EP-A-0 406 461).

The aluminium salt may, for example, be aluminium sulphate (e.g. paper makers alum), aluminium chloride, polyaluminium chloride or aluminium chlorohydrate.

The starch derivative is, as indicated, preferably a product as available under the trade mark RAIFIX.

The "one-shot" composition will generally have a solids content of at least 10% more usually at least 20%. Typically the solids content will be in the range 20% to 35%, e.g. 27% to 34% by weight.

For preference, the "one-shot" composition will be formulated so that the relative amounts of rosin, aluminium salt and starch derivative are in the ratio range 1:(1–1.5, e.g. ca 1.4):(0.1–0.5, e.g. ca 0.3).

The compositions in accordance with the invention may be produced by admixture of the various components followed by homogenisation to produce a smooth, low viscosity emulsion (preferably by initial mixing of rosin and starch derivatives prior to mixing of the aluminium salt).

"One-shot" compositions in accordance with the invention may be used for the sizing of paper and therefore according to a second aspect of the present invention there is provided a method of producing paper in which sizing of the fibres of the paper is effected using a "one-shot" composition in accordance with the first aspect of the invention.

The one-shot composition may be added at the wet-end of the paper making process (i.e. to a dispersion of the paper making fibres before the dispersion is laid onto the paper making wire machine or at a size press after formation of the paper web.

The amount of composition used for sizing the paper will typically be such that the amount of rosin is 0.2–3% dry basis on the weight of fibres.

The invention is illustrated by the following non-limiting Example.

EXAMPLE

Formulations A–G as identified in Table 1 were produced form the rosin emulsion identified under (1) below, at least one of the aluminium salts identified under (2), and one of the starch derivatives identified under (3).

(1) Rosin Emulsion

The rosin emulsion used was that available under the trade mark NEUSIZE 3 from Roe Lee Paper Chemical Co. It is a fortified gum rosin emulsion, with casein as a stabiliser, at 30% solids by weight.

(2) Aluminium Compound

The aluminium compound used was at least one of (a) paper makers alum (8% $Al_2O_3$)

(b) aluminium chloride (10.5% $Al_2O_3$)

(c) OULUPAC 180 (polyaluminium chloride (18% $Al_2O_3$)).

(3) Starch Derivative

The starch derivative used was one of (a) RAIFIX 25035 (20% solids) (3.5 m equivalents per gramme)

(b) RAIFIX 01015 (20% solids) (1.5 m equivalents per gramme)

(c) RAIFIX 01035 (40% solids) (3.5 m equivalents per gramme)

All formulations (i.e. A–G) were produced by mixing the identified components in the order indicated with a laboratory stirrer and then passing the resultant suspension through a Christisen Scientific Equipment Ltd, H5000, air powered microfluidiser to produce a smooth, low viscosity emulsion.

The mean particle size of the resultant emulsion and its stability are shown in Table 1.

Certain of the formulations were tested for their sizing properties. For this purpose, the 1 minute Cobb value was obtained for the 10th sheet in a series made with recycled backwater. This technique has been shown in other investigations to give results nearer those obtained on a full scale paper machine than single hand sheet results. The furnish used was a mixed hardwood, softwood furnish containing 70% birch and 30% bleached craft softwood. For comparison of the efficiency of the tested formulations, a similar test was conducted using NEUSIZE 3 and paper makers alum had a similar level of rosin addition and this resulted in a Cobb value of 20.8. During all of these experiments, a poly-acrylamide (Percol 63) was added at a rate of 300 g per tonne.

It can be seen from Table 1 that formulation B was a stable product which gave a similar Cobb value to the comparative sizing test using NEUSIZE 3 and paper makers alum. Formulation B is therefore the preferred formulation of Table 1.

A comparison of Formulations A and B illustrates that the method of addition can be important since both formulations were produced from the same components but using a different order of addition. Formulation A was susceptible to thickening and separation whereas Formulation B was preferably stable.

The combined use of OULUPAC 180 and paper makers alum in Formulation C resulted in the best sizing efficiency but combination but the combination of these two aluminium compounds (as used in Formulations C and D resulted in some thixotropy.

Formulations E and F also displayed some thixotropy but this could be controlled by changing the amount and type of RAIFIX.

What is claimed is:

1. A method of producing a "one-shot" composition for use in paper sizing comprising preparing an admixture of a rosin emulsion and a cationic starch derivative which has a charged state of 0.5 to 5.0 m equivalents per gram and which has been produced by a process in which the starch structure was split prior to the cationizing step, adding a soluble aluminium salt to the admixture, and effecting homogenization.

2. A method as claimed in claim 1 wherein the cationic starch derivative has a charged state of 0.5 to 4.5 m equivalents per gram.

3. A method as claimed in claim 2 wherein the cationic starch derivative has a charged state of 1.0 to 3.5 m equivalents per gram.

4. A method as claimed in claim 1 wherein the cationic starch derivative is a quaternized derivative.

5. A method as claimed in claim 4 wherein the quaternized derivative has a degree of substitution of at least 0.15 quaternary groups per glucose unit.

6. A method as claimed in claim 5 wherein the degree of substitution is 0.15 to 1.30 quaternary groups per glucose unit.

7. A method as claimed in claim 4 wherein the starch has been quaternized with 2,3-epoxypropyl trimethyl ammonium chloride.

8. A method as claimed in claim 1 wherein, for formulation into the "one-shot" composition the starch derivative is provided as a solution containing up to 55% by weight of the derivative.

9. A method as claimed in claim 1 wherein the "one-shot" composition has a solid content of at least 10%.

10. A method as claimed in claim 9 wherein the "one-shot" composition has a solids content of at least 20% by weight.

TABLE 1

Formulations of various one-shot emulsions and their properties

| Reference | Amounts | Method | Mean Particle size/μm | Stability | Cobb Value |
|---|---|---|---|---|---|
| A | 250 g Neusize 3<br>330 g Papermakers alum<br>46 g RAIFIX 25035 | RAIFIX added to alum<br>Neusize added to mixture<br>microfluidized | 7.5 | Thickened after 2 hours<br>Separated after 5 days | None measured |
| B | 250 g Neusize 3<br>330 g Papermakers alum<br>46 g RAIFIX 25035 | RAIFIX added to the Neusize<br>Alum added to the mixture<br>Microfluidized | 0.36 | No thickening<br>Sill perfectly fluid after 3 weeks, i.e. until filing date | 20.7 |
| C | 440 g Neusize 3<br>192 g Oulupac 180<br>193 g Papermakers alum<br>80 g RAIFIX 25035 | RAIFIX added to the Neusize<br>Mixture added to the 96 g Oulupac<br>Alum then added followed by 96 g of Oulupac<br>Microfluidized | 0.34 | Slight thickening after 3 days.<br>Thixotropic | 20.5 |
| D | 440 g Neusize 3<br>192 g Oulupac 180<br>193 g Papermakers alum<br>80 g RAIFIX 25035 | RAIFIX added to the Neusize<br>Alum added<br>Oulupac added<br>Microfluidized | 0.37 | Slight thickening after 3 days.<br>Thixotropic | None measured |
| E | 440 g Neusize 3<br>192 g Oulupac 180<br>193 g Papermakers alum<br>80 g RAIFIX 01035 | RAIFIX added to the Neusize<br>Mixture added to the 96 g Oulupac<br>Alum then added followed by 96 g of Oulupac<br>Microfluidized | 0.33 | Slight thickening after 3 days.<br>Thixotropic. | None measured |
| F | 440 g Neusize 3<br>192 g Oulupac 180<br>193 g Papermakers alum<br>80 g RAIFIX 01015 | RAIFIX added to the Neusize<br>Mixture added to the 96 g Oulupac<br>Alum then added followed by 96 g of Oulupac<br>Microfluidized | 0.45 | Slight thickening after 3 days.<br>Thixotropic | None measured |
| G | 220 g Neusize 3<br>255 g aluminium chloride<br>40 g RAIFIX 25035 | RAIFIX added to the Neusize<br>Aluminium chloride added to the mixture<br>Microfluidized | 0.37 | Less thickening than the alum/PAC blends. Not as fluid as the alum only blend | 21.9 |

11. A method as claimed in claim 10 wherein the "one-shot" composition has a solids content of 27% to 34% by weight.

12. A method as claimed in claim 1 wherein the relative amounts of rosin, aluminium salt and starch derivative are in the ratio rate of 1:1–1.5:0.1–0.5.

13. A method as claimed in claim 1 wherein the rosin is an anionic rosin emulsion.

14. A method as claimed in claim 1 wherein the rosin emulsion is a casein stabilized rosin emulsion.

15. A method as claimed in claim 1 wherein the rosin is a cationic rosin emulsion.

16. A method as claimed in claim 1 wherein the aluminium salt is aluminium sulphate, aluminium chloride, polyaluminium chloride or aluminium chlorohydrate.

17. A method as claimed in claim 1 wherein the relative amounts of rosin, aluminium salt and starch derivative are in the ratio of 1:1.4:0.3.

18. A "one-shot" composition for use in paper sizing comprising an admixture of a rosin emulsion, a soluble aluminium salt and a cationic starch derivative which has a charged state of 0.5 to 5.0 m equivalents per gram and which has been produced by a process in which the starch structure was split prior to the cationizing step.

19. A composition as claimed in claim 18 wherein the cationic starch derivative has a charged state of 0.5 to 4.5 m equivalents per gram.

20. A composition as claimed in claim 19 wherein the cationic starch derivative has a charged state of 1.0 to 3.5 m equivalents per gram.

21. A composition as claimed in claim 18 wherein the cationic starch derivative is a quaternized derivative.

22. A composition as claimed in claim 21 wherein the quaternized derivative has a degree of substitution of at least 0.15 quaternary groups per glucose unit.

23. A composition as claimed in claim 22 wherein the degree of substitution is 0.15 to 1.30 quaternary groups per glucose unit.

24. A composition as claimed in claim 1 wherein the starch has been quaternized with 2,3-epoxypropyl trimethyl ammonium chloride.

25. A composition as claimed in claim 18 wherein, for formulation in to the "one-shot" composition, the starch derivative is provided as a solution containing up to 55% by weight of the derivative.

26. A composition as claimed in claim 18 having a solids content of at least 10%.

27. A composition as claimed in claim 26 having a solids content of at least 20% by weight.

28. A composition as claimed in claim 27 having a solids content of 27% to 34% by weight.

29. A composition as claimed in claim 18 formulated so that the relative amounts of rosin, aluminium salt and starch derivative are in the ratio range 1:1–1.5:0.1–0.5.

30. A composition as claimed in claim 18 wherein the rosin is an anionic rosin emulsion.

31. A composition as claimed in claim 30 wherein the rosin emulsion is a casein stabilized rosin emulsion.

32. A composition as claimed in claim 18 wherein the rosin is a cationic rosin emulsion.

33. A composition as claimed in claim 18 wherein the aluminium salt is aluminium sulphate, aluminium chloride, polyaluminium chloride or aluminium chlorohydrate.

34. A composition as claimed in claim 18 formulated so that the relative amounts of rosin, aluminium salt and starch derivative are in the ratio range 1:1.4:0.3.

* * * * *